United States Patent [19]

Griswold, Jr. et al.

[11] Patent Number: 4,776,750

[45] Date of Patent: Oct. 11, 1988

[54] REMOTE CONTROL SYSTEM FOR EARTH WORKING VEHICLE

[75] Inventors: Frederick D. Griswold, Jr.; Bernard D. Bode, both of Dubuque, Iowa

[73] Assignee: Deere & Company, Moline, Ill.

[21] Appl. No.: 41,881

[22] Filed: Apr. 23, 1987

[51] Int. Cl.[4] ..... B66C 23/00

[52] U.S. Cl. ..... 414/698; 414/699; 37/103; 37/DIG. 19

[58] Field of Search ..... 414/699, 698; 37/DIG. 19, 103, DIG. 1

[56] References Cited

U.S. PATENT DOCUMENTS

| | | | |
|---|---|---|---|
| 3,348,709 | 10/1967 | Fauchere | 37/103 X |
| 4,171,054 | 10/1979 | Tanaka et al. | 37/103 X |
| 4,288,196 | 9/1981 | Sutton, II | 414/699 |
| 4,464,852 | 8/1984 | Rice . | |
| 4,508,013 | 4/1985 | Barbagli | 414/699 X |
| 4,633,383 | 12/1986 | Omachi et al. | 37/DIG. 19 X |

FOREIGN PATENT DOCUMENTS

| | | | |
|---|---|---|---|
| 2440875 | 3/1975 | Fed. Rep. of Germany | 414/699 |
| 59-44437 | 3/1984 | Japan | 414/698 |
| 8503096 | 7/1985 | PCT Int'l Appl. | 37/DIG. 19 |

OTHER PUBLICATIONS

Operating and Maintenance Manual for the Remotely Operated Mechanical Excavator (ROME), 6 sheets, Dec. 1982.

SAE Technical Paper Series 840851, May 1984.

*Primary Examiner*—Robert J. Spar

*Assistant Examiner*—Jennifer L. Doyle

[57] ABSTRACT

An implement has ground working tools mounted thereon moved by hydraulic motors and cylinders with each of the hydraulic motors and cylinders being adjusted through a main control valve. The main control valves are, in turn, controlled by two sets of valves, one set being pilot valves manually adjustable at an operator's station on the vehicle and the second being electro-hydraulic valves controlled from a remote area by radio signals received by a radio receiver on the vehicle. Safety switches are provided on the vehicle to block transmittal of the radio signals. The vehicle has a television camera mounted externally of the vehicle cab and directed internally thereof. The camera transmits images to a television screen at a remote area.

13 Claims, 3 Drawing Sheets

REMOTE CONTROL SYSTEM FOR EARTH WORKING VEHICLE

BACKGROUND OF THE INVENTION

This invention relates to a system for controlling the operation of a vehicle and tools mounted thereon from an area remote from the vehicle and through use of radio and television signal receivers and transmitters. This invention also relates to the hydraulic system on the vehicle that operates in conjunction with the signal receiving and transmitting means to permit the vehicle to be operated either manually, from the operator's station on the vehicle, or by an operator positioned in an area remote from the vehicle. It has heretofore been known to operate a vehicle from a remote area generating radio signals that adjust the operation of the vehicle. An operator's station is provided on the vehicle or implement such that an operator positioned in the operator's station may also manually control the various valves controlling the hydraulic motors. One of the problems that exists is in the area of safety. It is contemplated that the equipment may be used in dangerous areas, possibly where explosives exist, or toxic wastes, or where damage can be done to the vehicle and an operator, if he is in the operator's station, by falling debris or possible turnover of the vehicle. A main purpose of having remote controls for such a vehicle is to operate the vehicle from a remote area when the vehicle itself is under dangerous environmental conditions which could injure an operator.

SUMMARY OF THE INVENTION

With the above in mind, it is a primary purpose of the present invention to provide a vehicle in which there are groundworking tools carried on supporting structure by the vehicle and in which the supporting structure and tools are moved by hydraulic motors, each of the hydraulic motors being under control of a main control valve. For purposes of the present disclosure, the term "hydraulic motors" shall be inclusive of the rotary type hydraulic motor, hydraulic cylinders and any type of hydraulic motor utilized to move or adjust the vehicle or any of its parts. The main control valves are, in turn, controlled by two sets of valves, one set being manual pilot valves which are positioned in the operator's station and controlled manually from the operator's station. The second set is electrohydraulic valves which also move fluid to and from the respective main control valves for actuation of the motors. The electrohydraulic valves are controlled from a remote area by radio signals that are received by a radio receiver on the vehicle.

It is a further purpose of the present invention to provide sufficient means by which an operator may operate the manual pilot valves and a remote operator may control the electrohydraulic valves. The operator's station has two electrical switches therein . . . one which completely shuts off the radio receiver and consequently, the remote controls, and a second with which the operator operates the entire electrical system on the tractor or vehicle, such as for use in operation the engine, lights, horns, etc.

It is still a further purpose of the present invention to provide in the system an overriding control available to the operator at his station which gives him the ability to operate his manual pilot valves even if the vehicle, at the time, would accidentally or otherwise, be operated by an operator at the remote area.

Still more particularly, it is the further object of the present invention to provide in the manual pilot valves a springloaded control which always moves the pilot valves into a position in which fluid is moved from the main control valves, through the electrohydraulic valves, and through the manual pilot valves, to sump. Also, the electrohydraulic valves are biased to a position by which they merely pass fluid, as desired by an operator, at the operator's station through the electrohydraulic valves to the main control valves for the respective hydraulic motors. A single pressure source is provided for the manual pilot valves as well as the electrohydraulic valves, and a selector valve is provided whereby the fluid from the pressure source may be diverted from the elettrohydraulic valves.

It is a further purpose of the present invention to provide a television camera external of the operator's station for the purpose of remotely viewing the working tool and also adapted to be directed internal of the station for sending signals to a remote receiver of conditions within the station. More specifically, it is the purpose of the invention to provide at the operator's station a cab with a roof having a roof hatch. A television camera is adjustably mounted on the roof adjacent the hatch and may be moved to be directed through the hatch opening so as to view the control panel and other controls in the operator's station. Thus, an operator, at a remote area from the excavator may review the gauges, warning lights and controls on the excavator just as an operator would if he were at the operator's station on the vehicle.

DESCRIPTION OF THE DRAWINGS

FIG. 3 is a top and side perspective view of the upper portion of the operator's station or cab.

DESCRIPTION OF THE PREFERRED EMBODIMENT

Figure 1:
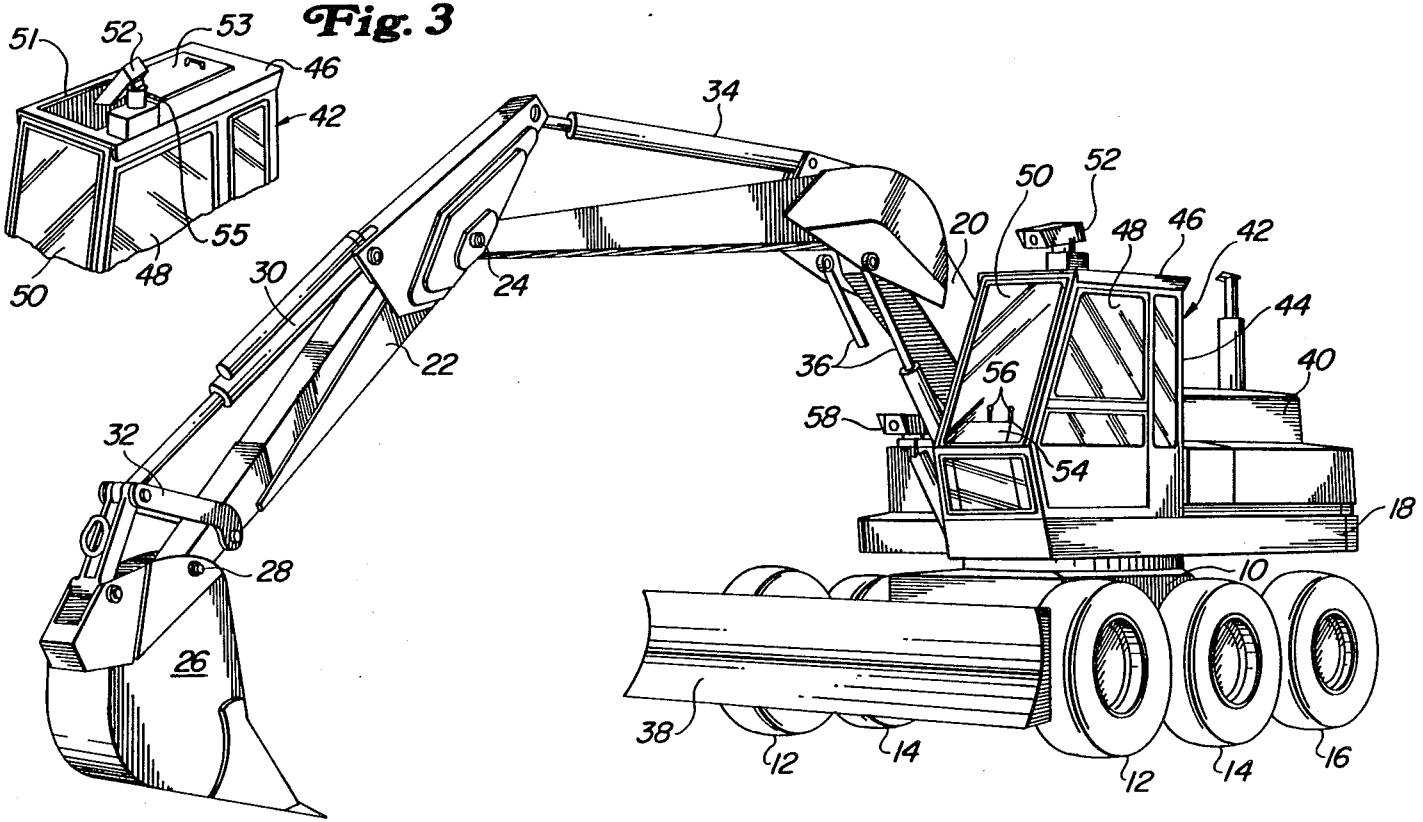
FIG. 1 is a front perspective view taken from the forward left side of an excavator-type vehicle utilizing the electrical and hydraulic system of the present invention with portions broken away to show what would otherwise be hidden structure.

Referring now to FIG. 1, there is provided an excavator-type vehicle that includes the main undercarriage 10 having two sets of three wheels 12, 14, 16 on opposite sides of the chassis. An upper subframe 18 is supported for rotation about a vertical axis on the undercarriage 10. The manner of rotating the frame 18 on the undercarriage 10 is of conventional nature and forms no part of the present invention other than to recognize that a hydraulic motor is required to exert the work or force necessary for turning of the subframe 18. Carried on the subframe 18 is a boom structure that includes a main boom 20 and an arm 22 pivotally mounted on a horizontal pin structure 24 on the end of the main boom 20. On the extreme outer end of the arm 22 is an earth-working tool in the form of a bucket 26. The bucket, as in conventional manner, is carried on a horizontal pin 28 and movement of the bucket 26 on the pin 28 is created by an hydraulic motor or cylinder 30 through the action of linkage indicated in its entirety by the reference numeral 32. The term "hydraulic motor" for purposes of the present description is meant to be inclusive of all hydraulic motors that supply the work or force necessary to operate the vehicle or position all or any part of the working tools on the implement. The upper end of the arm 22 projects above the pivot pin structure 24 and a hydraulic motor 34 is provided for shifting and moving the arm 22 vertically with respect to the main boom 20. Extending between the subframe 18 and the main boom 20 are a pair of hydraulic motors or cylinders 36 that move the boom 20 vertically on the subframe 18. Thus, with rotation of the subframe 18 on the carriage 10, and through the operation of the motors 30, 34, 36, the working tool 26 may be moved to various locations and positions for working earth in and about the implement.

Also positioned on the undercarriage 10 and extending forwardly therefrom is a transverse bulldozer blade 38. The manner of mounting the bulldozer blade 38 on the undercarriage 10 is known. The exact method of mounting the blade 38 on the sub-frame is not of particular importance relative to the present invention other than to recognize that the blade 38 may be raised and lowered for different positions of working and the raising and lowering is done by hydraulic motors or cylinders which are not shown.

Also carried on the subframe 18 is an engine mounted under a hood 40 which provides power for the hydraulic system and vehicle in general. An operator's station, indicated in its entirety by the reference numeral 42, is also carried on the subframe 18, and includes a cab or enclosure 44 with a roof 46. Windows, such as at 48, 50, serve to close the cab from the elements. Referring to FIG. 3, particular reference is made to the roof 46 and to the hatch opening 51 at its forward end. A hatch door 53 is hinged at 55 for purposes of providing access through the opening. The door, when opened, exposes from above an instrument panel 54 with suitable controls such as at 56. Mounted on the roof 46 and offset to the side of opening 51 is a television camera 52 which may be tilted downwardly to be directed downwardly through the hatch opening so that the instrument panel 54 and all other controls within the operator's station may be transmitted by the camera 52, it being understood that suitable mechanism capable of being remotely controlled is used to so position the camera 52. The camera can also be aimed in a panorama around the unit and downward to get a close-up view of the working area of the tool 26. This camera also has zoom capability to vary the range of view. A second television camera 58 is provided on the opposite side of the subframe 18 and along its forward portion for reviewing the work done by both the bulldozer blade 38 and the bucket or working tool 26.

Figure 2:
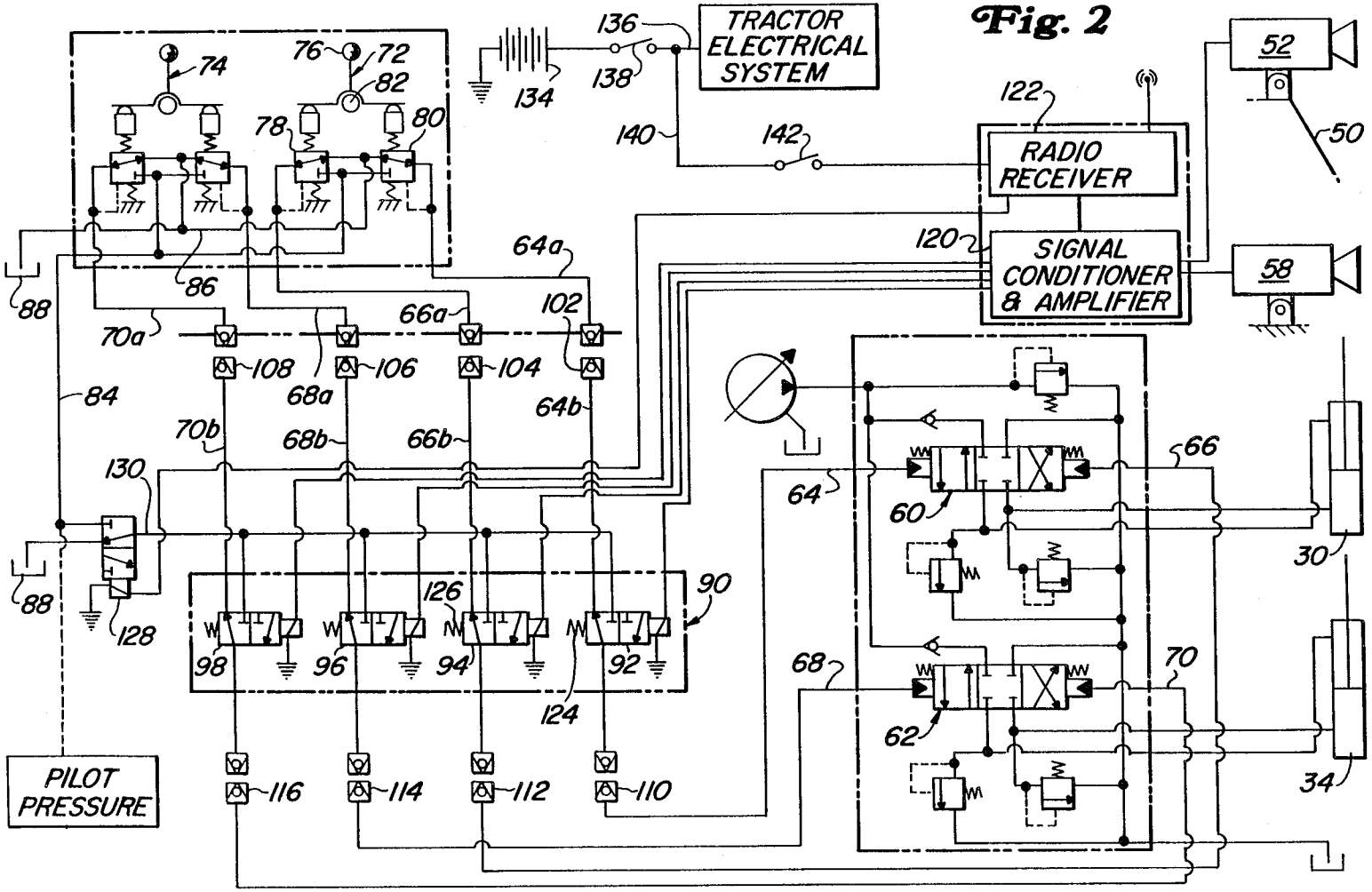
FIG. 2 is a schematic view of the valve control system on the excavator and showing a portion of the electrical system thereon.
Figure 4:
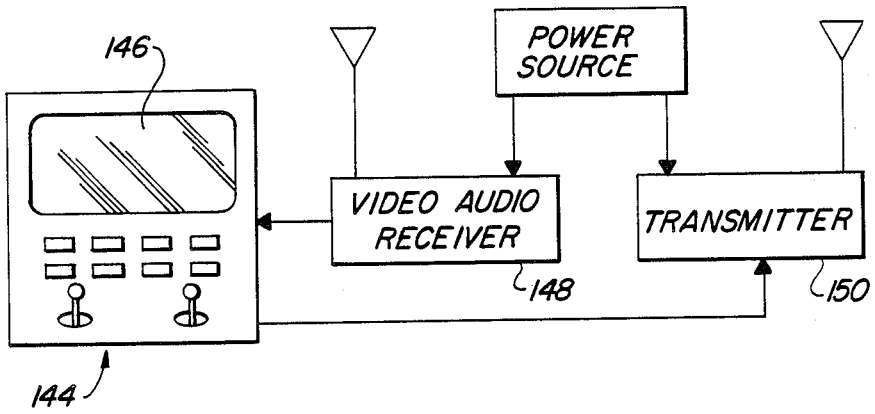
FIG. 4 is a schematic view of a remote control system for operating the valve control system and electrical system on the vehicle.

Referring now to FIG. 2, the hydraulic system and electrohydraulic system operating the various positioning structure for the working tools 26, 38, (FIG. 1), is shown in schematic form. For illustrative purposes only, two hydraulic motors 30, 34 and their related control structure are shown. It is understood that other hydraulic motors or cylinders, such as cylinders 36, the bulldozer positioning cylinders and others on the implement are controlled in similar manner. The hydraulic cylinders 30, 34 are independently operated in this instance first by their own main control valves such as at 60, 62. Each main control valve 60, 62 is a spool type of conventional nature with lines such as at 64, 66 feeding to and extending from opposite ends of the respective valve 60 and as at 68, 70 extending from opposite ends of the spool valve 62. It should here be understood that while only two motors, 30, 34 are shown in FIG. 2, a similar control valve arrangement is provided for all of the hydraulic motors on the excavator. Likewise, respective controls, hereinafter to be described, relative to the control valves 60, 62 are similarly provided for the hydraulic motors on the excavator.

A manual hand-pilot control valve arrangement, such as shown at 72, is provided for the control valve 60 and is connected into lines 64*a*, 66*a*. Similarly, a hand control valve arrangement 74 is connected to lines 68*a*, 70*a* and operates to adjust the control valve 62. As will become apparent, the lines 64*a*–70*a* are eventually connected to lines 64–70. Since the hand-controlled pilot valves 72, 74 are identical, description of only the pilot valve 72 and its connection and association with the control valve 60 will be given, it being understood that the operation and use of the pilot valve arrangement 74 is identical.

The pilot valve arrangement 72 includes a hand lever 76. The lever 76 controls through a pivoting arrangement at 82 a pair of proportional reducer valves 78, 80. A low pressure line 84 extends to the valves 78, 80. A return line 86 extends from the valves 78, 80 to a tank or sump 88. The valves 78, 80 are spring-loaded to be biased to a position in which the fluid in lines 64*a*, 66*a* moves through the respective valves 78, 80 and into the return line 86 to then return to sump 88. Adjustment of the valves 78, 80, through adjustment of the lever 76, will move fluid under pressure through the line 64*a* or 66*a*, as the case may be, to the respective ends of control valves 60. Pressure in one of the lines 64*a*, 66*a* normally will provide a return line from the other of the lines 64*a*, 66*a* and the return line will, of course, pass through the pilot valve 72 and return to sump.

Interspaced between the hand pilot valves 72, 74 and the control valves 60, 62 is a bank of electrohydraulic converter valves, indicated in its entirety by the reference numeral 90. The bank of electrohydraulic converter valves include valves 92, 94, 96, 98. The valve 92 is connected to the line 64*a* by line 64*b* and a quick coupler 102. The valve 94 is connected to the line 66*a* by line 66*b* and a quick coupler 104. The valve 96 is connected to the line 68*a* by line 68*b* and a quick coupler 106. The valve 98 is connected to the line 70*a* by line 70*b* and a quick coupler 108.

Similarly, the valve 92 is connected to line 64 by quick attach coupler 110. The valve 94 is connected to line 66 by a quick coupler 112. The valve 96 is connected to line 68 by a quick coupler 114. The valve 98 is connected to the line 70 by a quick coupler 116. As is clearly apparent from viewing the drawings, the couplers 102, 104, 106, 108 and 110, 112, 114, 116 may be disconnected and the entire valve bank 90 removed, if desired, from the vehicle. By coupling the male portions of the quick couplers on the hand pilot valve side to the complementary female portions of the quick couplers on the main control valve side, the hand pilot valves may be connected directly to the main control valves thereby bypassing the electrohydraulic valves.

Since the electrohydraulic converter valves are identical in function with respect to their hand pilot valves and their main control valves, only the two valves 92, 94 will be described in detail with their relation to the hand pilot and main control valves, it being understood that any of the other valves would operate in substantially the same manner, as desired.

The electrohydraulic converter valves 92, 94 are two-position valves and are controlled from a signal conditioner and amplifier 120 which receives its instructions or directions from a radio receiver 122. The amplifier 120 and receiver 122 are, of course, mounted on the vehicle. When connected but not in use, the valves 92, 94 are spring-loaded at 124, 126 to a position where fluid may flow freely through the lines **64, 64*b*, and 64*a* and similarly, fluid may flow freely through lines 66, 66*b*, 66*a*. A selector valve 128 is connected to the line 84 and may be shifted to move fluid under pressure into a pressure feed line 130 that leads to each of the electrohydraulic converter valves 92–98**.

The selector valve 128 is controlled from the radio receiver 22. The valve 128 may be shifted to move fluid through the feeder line 130 to the respective electrohydraulic valves. Referring only to valve 72, when the hand pilot valve 72 is in a non-operative position, the fluid moving through the line 84 is blocked at valves 78, 80. Referring again to valves 92, 94, when they are energized by the amplifier 120, they will be shifted so that fluid moving through the feeder line 130 will move to the line 64, 66, as desired. As fluid is moved through the line 64, fluid will be returned through the line 66 and through the valve 94 to be returned through the pilot valve 78, to the return line 86 and from there to sump. When fluid is moved under pressure through the valve 94 from the feeder line 130, which occurs when the valve 94 is energized, the returned fluid will move through the line 64, the valve 92 and through the pilot valve 80 and from there through line 86 to sump. Thus, by having the hand pilot valves biased to a position so that fluid moves from the lines **64*a*, 70*a*** to sump, the electrohydraulic converter valves, in fact, are placed in series with the hand pilot valves and with the main control valves.

Carried on the excavator-type vehicle is a conventional type battery 134 with a circuitry 136 extending to the tractor or vehicle electrical system used for operation of the engine, such as lights, heater, starter, etc. In the circuitry 136 is a main switch 138 which is positioned at the operator's station and may be obviously controlled by an operator at that station. Extending from that line 136 in downstream relation to the switch 138 is a parallel line 140 that leads to the radio receiver 122. Carried in the line 140 is a manually operated switch 142 which is also controlled at the operator's station by an operator at that station. Therefore, it becomes apparent that if the vehicle is to be manually operated, the operator closes the switch 138 and opens the switch 142. This permits the operator to control the vehicle in the conventional manner. However, should it be desired to have the vehicle be controlled from a remote area, both the switches 138, 142 are closed and the operator leaves the area of the operator's station. It is contemplated that the control panel 54 and the control levers 56, that are in the operators' station, will be duplicated either identically or in miniature form on a control panel 144 in a remote area, and that an operator at the remote area will have the ability to operate the controls as desired. It is further contemplated that the remote area will have a video monitor 146 and receiver 140 that receives video and displays the video images taken by from the television cameras 52 or 58 for viewing the operation of the implement from that remote area. The aforementioned control panel 144 at that remote area transmit signals from a transmitter 150 at the remote area to the radio receiver 122 and the receiver will then feed such information to the signal conditioner and amplifier 120 so that the respective electrohydraulic valve system 90, as shown in FIG. 2, may be used to control the positioning and working of the tools.

For safety purposes, it is contemplated that an operator in the operator's station should have control of the vehicle over and above that of a person controlling the vehicle at a remote station. Consequently, the switches 138, 142 are positioned for his safety, as well as for proper operation of the vehicle. Should, for some reason, he neglect or forget to open the switch 142 when he desires to operate the equipment manually, and should a signal be received by the radio receiver 120 to adjust the electrohydraulic converter valves, 92–94, the operator may quickly take control by opening switch 142 or through manual adjustment of the pilot valves 72, 74 since these valves are connected in series with the electrohydraulic valves 92–98.

We claim:

1. In an excavator-type vehicle having a tool-supporting multiple boom structure and a working tool carried thereon, a plurality of hydraulic motors positioning respective parts of said boom structure and said tool, said motors having main control valves; a pilot valve for each of said main control valves, each pilot valve being adjustable to alternate pressure and return between the respective pilot valves and the respective main control valves and for returning fluid from the main control valves through the pilot valves to sump; electrohydraulic valves in the lines between the pilot and main control valves, each being biased to one position permitting uninterrupted movement of fluid through said lines and shiftable to another position to block pressure from said pilot to said main control valves, each of said electrohydraulic valves, when in said another position, providing a pressure outlet in communication with a line between the respective electrohydraulic valve and a respective main control valve while retaining return of fluid through the respective pilot valve to sump; an electrical power source on said vehicle and associated control means for positioning the respective electrohydraulic valves; a pressure source in communication with each of said pilot valves and each of said electrohydraulic valves; and a selector valve selectively shiftable to block communication between the pressure source and said electrohydraulic valves.

2. In an excavator-type vehicle having a tool-supporting multiple boom structure and a working tool carried thereon, a plurality of hydraulic motors positioning respective parts of said boom structure and said tool, said motors having control valves; a pilot valve for each of said main control valves, each pilot valve being adjustable to alternate pressure and return between the respective pilot valves and the respective main control valves; electrohydraulic valves in the lines between the pilot and main control valves, each being biased to one position permitting uninterrupted movement of fluid through said lines and shiftable to another position to block pressure from said pilot to said main control valves, each of said electrohydraulic valves, when in said another position, providing a pressure outlet in communication with a line between the respective electrohydraulic valve and a respective main control valve while retaining return of fluid to sump; an electrical power source on said vehicle and associated control means for positioning the respective electrohydraulic valves; a pressure source in communication with each of said pilot valves and each of said electrohydraulic valves; and a selector valve selectively shiftable to block communication between the pressure source and said electrohydraulic valves.

3. The invention defined in claim 2 in which said vehicle has a vehicle electrical system and said electrical power source is further utilized to operate the vehicle electrical system, and further characterized by a master switch between the power source, and said electrical system and said associated means for positioning the respective electrohydraulic valves; and a second switch downstream from the master switch for effecting power only to said associated means for positioning the respective electrohydraulic valves.

4. The invention defined in claim 3 in which said associated means for positioning the respective electrohydraulic valves includes a signal receiver and amplifier that is controlled from an area remote from said vehicle.

5. The invention defined in claim 3 in which at least one of said hydraulic motors is used to swivel said boom structure about a vertical axis of the vehicle and further characterized by an operator's station mounted on the vehicle and swingable with the boom structure about the same vertical axis, said operator's station further having control indicia and mechanism located generally to be forward of an operator positioned in the station, and said operator's station further including an implement cab having a roof with a roof opening to expose the control indicia and mechanism from above; a television camera mounted on said roof and controlled by the signal receiver and amplifier to direct the camera through the roof opening toward the indicia and mechanism at said operator's station; and a transmitter on the vehicle for transmitting images taken by said camera to the aforesaid remote area from the vehicle.

6. The invention defined in claim 2 in which the electrohydraulic valves are in valve stacks and are connected to their respective pilot valves by quick couplers and to their respective main control valves by quick couplers so that the entire stack may be disconnected and the pilot valves may be connected directly to the main control valves by joining the quick coupler parts on the pilot valve side to the quick coupler parts on the control valve side.

7. The invention defined in claim 2 further characterized in that the electrohydraulic valves when in said another position, permit return fluid from the main control valves to move to the pilot valves.

8. The invention defined in claim 7 in which the pilot valves are biased to a rest position whereby return fluid moves through the pilot valve and returns to sump.

9. In an excavator-type vehicle having a tool-supporting multiple boom structure and a working tool carried thereon, a plurality of hydraulic motors positioning respective parts of said boom structure and said tool, said motors having main control valves; a pilot valve for each of said main control valves, each pilot valve being adjustable to alternate pressure and return through lines extending between the respective pilot valves and the respective main control valves for adjusting the latter and for returning fluid from the main control valves through the pilot valves to sump; electrohydraulic valves in the lines between the pilot and main control valves, each being biased to one position permitting uninterrupted movement of fluid through said lines and shiftable to another position to block pressure from said pilot to said control valves, each of said electrohydraulic valves, when in said another position, providing a pressure outlet in communication with a line between the respective electrohydraulic valve and a respective main control valve while retaining return of fluid through the respective pilot valve to sump; a remotely controlled signal receiver and amplifier on said vehicle for controlling the respective electrohydraulic valves; a pressure source; a pressure line extending between said source and each of said pilot valves and between said source and each of said electrohydraulic valves; a selector valve selectively shiftable to block communication between the pressure source and said electrohydraulic valves; and electric power source on the vehicle including a circuit providing electrical power to said signal receiver and amplifier; an operator's station on the vehicle; and manual controllable switch means at said operator's station in said circuit.

10. The invention defined in claim 9 in which the vehicle has a vehicle elecrical system and further characterized by a circuit extending between said power source and the vehicle electrical system and in which the switch means includes a switch for breaking the circuit between the power source and vehicle electrical system.

11. In an excavator-type vehicle in which there is provided an operator's station mounted to swing about a vertical axis on a vehicle chassis and including a tool-carrying, multiple boom structure also mounted to swivel about the same axis and with the station, said station further having operator controls and operating indicia located in the station and in which the vehicle chassis and structure has the capability of being remotely controlled by signals transmitted from a remote station, the improvement comprising: an implement cab having a roof and a roof hatch to expose the controls and indicia from above; a television camera mounted on said roof and adapted to tilt downwardly to direct the camera toward the controls and indicia; and a transmitter on the vehicle for transmitting images taken by said camera to said remote station.

12. On a tractor-type vehicle having a tool-supporting structure and a working tool carried thereon, a plurality of hydraulic motors positioning respective parts of said tool, said motors having main control valves; a pilot valve for each of said main control valves, each pilot valve being adjustable to alternate pressure and return between the respective pilot valves and the respective main control valves; electrohydraulic valves between the pilot and main control valves, each electrohydraulic valve being biased to one position, permitting uninterrupted movement of fluid through said lines and shiftable to another position to block pressure from said pilot to said main control valves, each of said electrohydraulic valves, when in said another position, providing a pressure outlet in communication between the respective electrohydraulic valve and a respective main control valve while retaining return of fluid to sump; an electrical power source on said vehicle and associated means for positioning the respective electrohydraulic valves; a pressure source in communication with each of said pilot valves and each of said electrohydraulic valves; and a selector valve selectively shiftable to block communication between the pressure source and said electrohydraulic valves.

13. In an implement in which there is provided an operator's station mounted to swing about a vertical axis on a vehicle chassis and including a tool-carrying boom structure also mounted to swivel with the station about the same axis, said station further having an implement cab with operator controls and indicia located internally thereof, and in which the vehicle chassis and structure have the capability of being remotely controlled by signals transmitted from a remote station, the improvement comprising: a television camera mounted externally on the cab adjustable to direct the camera toward said indicia and said controls; and a transmitter on the vehicle for transmitting images taken by said camera to said remote station.

* * * * *